United States Patent [19]

Ostberg

[11] Patent Number: 4,583,651

[45] Date of Patent: Apr. 22, 1986

[54] NOVELTY BOTTLE CAP-TOY TOP

[76] Inventor: Werner Ostberg, 210 Skyline Dr., Easton, Pa. 18042

[21] Appl. No.: 716,261

[22] Filed: Mar. 26, 1985

[51] Int. Cl.[4] ..... B65D 51/24

[52] U.S. Cl. ..... 215/228; 446/71

[58] Field of Search ..... 446/71; 215/228

[56] References Cited

U.S. PATENT DOCUMENTS

| | | | |
|---|---|---|---|
| 1,644,182 | 10/1927 | Dailey . | |
| 2,332,507 | 10/1943 | Dailey | 273/147 |
| 2,700,246 | 1/1955 | Ostberg | 46/64 |
| 3,009,594 | 11/1961 | Anson | 215/228 |
| 3,176,740 | 4/1965 | Yohe | 215/228 X |

*Primary Examiner*—Donald F. Norton

*Attorney, Agent, or Firm*—Joseph J. O'Keefe

[57] ABSTRACT

A novelty bottle cap-toy top which, may be used to seal a bottle and/or a toy top. The bottle cap-toy top comprises a hollow shell of generally semi-spherical configuration and a stem. The hollow shell has a top flat outer surface and opposite thereto a lower opening through which there is an inwardly extending sealing portion adapted to engage and seal the throat of a bottle. The stem, generally perpendicular to both the top flat outer surface and the plane of the lower opening, extends from the interior of the cap, through the opening, and outwardly therefrom. When the cap, top flat portion down, is spun by the stem on a horizontal surface, the cap will rotate out of its central axis through ever larger circles until the end of the stem contacts the horizontal surface causing the cap to jump into an inverted position and spin on the tip of the stem. As the spinning slows, the top falls, rolls on its surface and comes to rest on the top flat face.

7 Claims, 13 Drawing Figures

FIG. 1
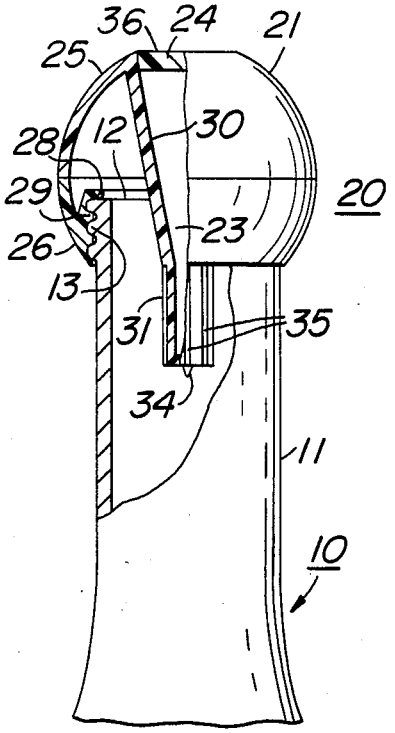
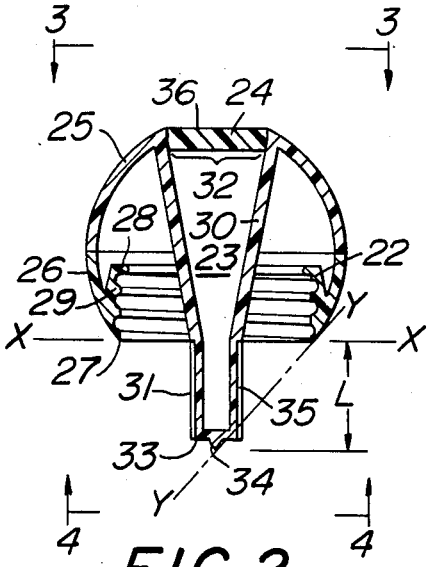
FIG. 2
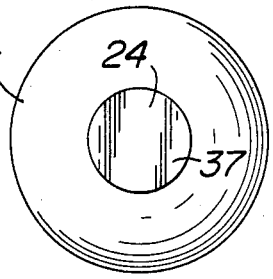
FIG. 3
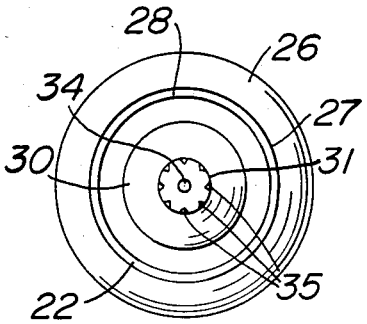
FIG. 4
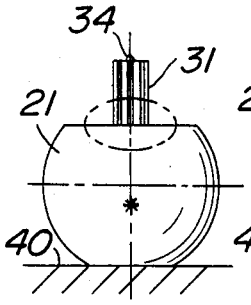
FIG. 5
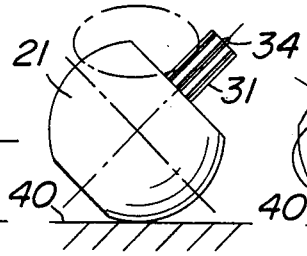
FIG. 6
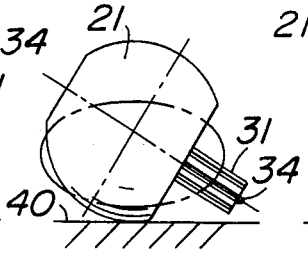
FIG. 7
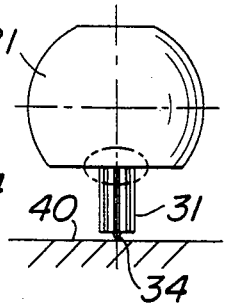
FIG. 8

FIG. 9
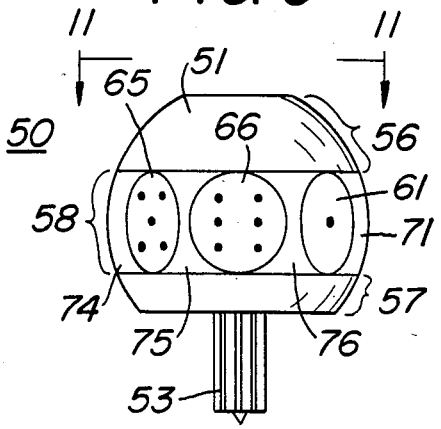
FIG. 10
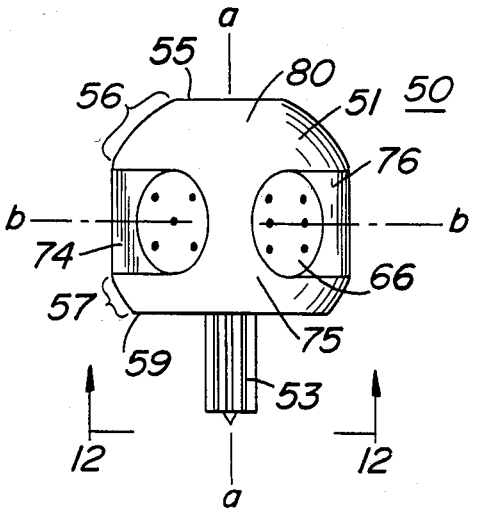
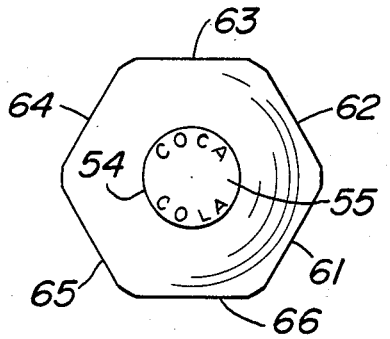
FIG. 11
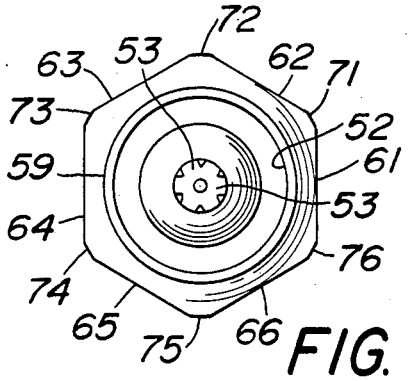
FIG. 12
FIG. 13
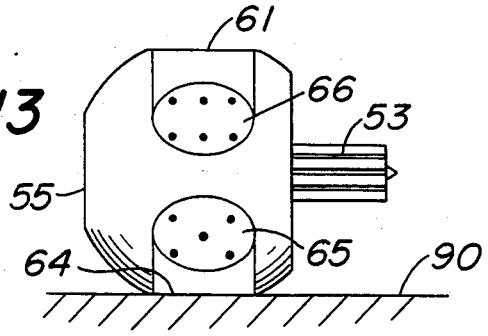

NOVELTY BOTTLE CAP-TOY TOP

BACKGROUND OF THE INVENTION

The present invention relates to a bottle cap and more particularly to a novelty bottle cap, which may be used to seal a bottle, and subsequently, may be used as a toy top.

Caps of various designs are used to seal bottles containing all types of liquids and granular solids. In some instances the caps have been adorned with figures, advertising words or symbols, or combined with utilitarian features, such as metering devices for dispensing liquids. Due to the large number of capped bottles that are sold throughout the world each year, bottle caps offer a low cost, highly visible means of promotion for manufacturers of bottled beverages. Consequently, an inexpenive novelty cap that attracts the consumers attention can be a valuable marketing aid.

SUMMARY OF THE INVENTION

Accordingly, it is an object of this invention to provide a novelty bottle cap that is simple and inexpensive to produce and functions in a utilitarian manner to seal the top of a beverage bottle.

It is another object of the invention to provide a cap that may be used, after removal from a bottle, and/or in conjunction with a game or as a toy.

A further object of the invention is to provide a bottle cap-toy top having a surface suitable for advertising purposes.

In keeping with these objects and with others which may become apparent hereafter, the present invention resides in a hollow bottle cap-toy top cap of generally spherical configuration, having a projecting stem, which extends into the bottle, and opposite thereto a top flat portion upon which the cap may normally rest after its removal from the bottle. When the cap, flat portion down, is spun by the cap stem on a horizontal surface, the cap will spin in ever winding circles until the end of the stem contacts the horizontal surface, causing the cap to jump into an inverted position and spin, in the reverse direction, on the end of the stem until the spinning slows and the top tips over.

These and other objects of the invention will be more fully understood by reference to the following description and claims, when read in connection with the accompanying drawings.

BRIEF DESCRIPTION OF THE DRAWINGS

FIG. 1 is an elevation view, partly in section, of one embodiment of the novelty bottle cap-toy top of this invention mounted on the neck of a bottle.

FIG. 2 is a longitudinal sectional view of the novelty bottle cap of this invention.

FIG. 3 is a top view taken on the lines 3—3 of FIG. 2.

FIG. 4 is a bottom view taken on the lines 4—4 of FIG. 2.

FIGS. 5-8 illustrate the movements of the novelty bottle cap-toy top of this invention when spun as a toy top.

FIG. 9 is an elevation view of a modified novelty bottle cap-toy top of this invention that may be used for a game.

FIG. 10 is an elevation view of the modified bottle cap-toy top shown in FIG. 9, rotated clockwise through an angle of 30 degrees about the central axis.

FIG. 11 is a top view of the modified novelty bottle cap-toy top taken on the lines 11—11 of FIG. 9.

FIG. 12 is a bottom view of the modified novelty bottle cap-toy top taken on the lines 12—12 of FIG. 10.

FIG. 13 is a side elevational view of the modified novelty cap-toy top of FIG. 9 after it has been spun and permitted to come to rest on a horizontal surface.

DETAILED DESCRIPTION OF THE PREFERRED EMBODIMENTS

As shown in FIG. 1, bottle 10, having a narrow neck 11 with open end 12 and raised outer ribs or threads 13 adjacent end 12, is sealed by the novelty bottle cap-toy top 20 of this invention. Cap 20 comprises hollow, thin shell 21, having a bottle sealing portion 22, stem portion 23 and top closure 24.

Shell 21 includes an upper semi-hemispherically shaped portion 25 and a lower semi-hemispherically shaped portion 26. Extending inwardly of lower portion 26 is bottle sealing portion 22 that includes outer end 27, inner end 28 and threaded bottle contact surface 29, all circular in shape. Inner end 28 has a diameter smaller than that of bottle contact surface 29 for reasons hereinafter described.

Stem portion 23 includes upper truncated conical section 30 that connects with lower cylindrical section 31. The upper end of conical section 30 has an opening 32 and the lower end of cylindrical section 31 has a closed flat end 33, with an external tip 34. Serrations 35 extend longitudinally of the periphery of cylindrical section 31.

Top closure 24, which seals opening 32 of the upper end of conical section 30, has a diameter equal to that of opening 32 and a substantially flat outer surface 36. The flat surface 36 of top closure 24 and cylindrical section flat end 33 of stem portion 23 are generally parallel to one another and substantially perpendicular to the central vertical axis of shell 21, stem portion 23 and circular shaped bottle sealing portion 22. Top closure 24 has a thickness greater than that of thin shell 21 to position the center of gravity of cap 20 along the central vertical axis and slightly above the transverse centerline, as shown by the asterisk in FIG. 5, although in this figure the cap is inverted.

Shell 21 is described herein as semi-spherical because its external contour is spherical, except for the flat outer surface 36 of top closure 24 and the cut off portion of shell lower portion 26, as best seen in FIG. 2.

The diameter of top closure 24 should be at least ¼" and not exceed about one-half the diameter of shell 21. The length of stem portion 23 that extends radially from shell 21 is equal to the distance L, as shown in FIG. 2. L is the distance along the central longitudinal axis of cap 20, from its intersection with plane X—X, which passes transversly of said axis through the outer circular end 27 of bottle cap contact surface 29 and stem lower cylindrical section 31, and the intersection of said axis with an imaginary line Y—Y drawn tangentially to the surface of shell 21 where it passes through plane X—X. The imaginary line intersects the central axis at tip 34.

When cap 20 is secured in place on bottle 10, bottle contact surface 29 of bottle sealing portion 22 meshes with threads 13 of bottle neck 11, and the open end 12 of neck 11 contacts the inner end 28 of cap sealing portion 22 to cause cap 20 to effectively seal bottle 10 and prevent the leakage of any liquid or gas from the bottle.

As shown in FIG. 5, after cap 20 is removed from bottle 10 and placed on a horizontal surface 40, cap 20 will normally roll on the surface of shell 21 and come to rest on flat surface 36 of top closure 24, with stem portion 23 extending upwardly. When cylindrical section 31 of stem portion 23 is grasped between a person's thumb and fingers, aided by the serrations, and caused to rapidly spin on a horizontal surface 40, the combination of flat surface 36 of top closure 24 and its thickness will promptly cause the cap top 20 to rotate out of its central longitudinal axis and through ever larger circles, as shown in FIGS. 5, 6 and 7. When end 33 of stem cylindrical section 31 contacts horizontal surface 40, as shown in FIG. 7, serrations 35 on section 31 will further increase the friction between stem end 33 and horizontal surface 40 and cause cap top 20 to rotate or jump into an inverted position on tip 34, with reverse rotation, as shown in FIG. 8. Cap top 20 will continue to spin until it loses speed and falls over onto shell 21 and then rolls into an upright position resting on flat surface 36 of top closure 24.

In the embodiment cap-toy top described above, shell 21 has an outside diameter of about 1⅝", top closure 24 has a diameter of about ⅝" and stem cylindrical section 31 has a diameter of about 5/16" and extends about ⅝" beyond the end of cap bottle sealing portion outer end 27. Bottle contact surface 29 of bottle sealing portion 22 is adapted to fit bottle 10 having a neck 11, with an outside diameter of about 1 1/16", plus the dimensions of threads 13. The embodiment is designed to be formed, from a suitable plastic material, in three parts: (1) shell upper portion 25 and stem portion 23, (2) shell lower portion 26 and bottle sealing portion 22, and (3) top closure 24. The parts are economical to make and easily cemented together to form a bottle cap-toy top that will function both to effectively seal a beverage bottle and/or used as a toy top. The bottle cap-toy top can be made of any number of pieces, depending upon the manner in which they are formed. Preferably, the diameter of shell 21 should be about 1.5× diameter of the O.D. of the bottle with which the cap is used. The bottle cap of this invention can be used repeatedly to seal the end of a bottle with which the cap sealing portion is compatible.

The above described embodiment of the bottle cap-toy top 20 of this invention has been described with respect to its use with a bottle having a screw end. Other embodiments of the bottle cap-toy top can also be made to use with bottles having other than screw-type ends, for example bottles with ridge ends for crimped caps.

The surface of shell 21 and top closure 24 can be produced in a variety of colors or adorned with printed or with eye catching slogans, numbers or trademarks. Consequently, the present invention may be used as a promotional device to market a variety of beverages.

While heretofore the novelty bottle cap of this invention has been described as having a hollow shell of semi-spherical configuration, the bottle cap-toy top shell may be modified to include a plurality of flat faces that are substantially parallel to the central axis of the shell. These faces can be marked with numbers, spots, figures, etc. so that the bottle cap-toy top may be used in playing a variety of games in place of dice, cards, etc.

As shown in FIGS. 9–11, bottle cap-toy top 50 comprises a hollow thin shell 51 having a bottle sealing portion 52, stem portion 53 and top closure 54, which has a flat outer surface 55. Shell 51 comprises a semi-hemispherical upper portion 56, a semi-hemispherical lower portion 57 and an intermediate portion 58. Bottle sealing portion 52 has outer end 59 where the bottle contact surface joins with lower portion 57 of shell 51. Intermediate portion 58 includes six faces 61, 62, 63, 64, 65 and 66, which are separated from one another by convexly curved transition sections 71, 72, 73, 74, 75 and 76, respectively. Preferably, the faces 61–66 are of the same size, substantially flat and equally spaced about intermediate portion 58. The curved transition sections each extend between shell upper portion 56 and shell lower portion 57 forming therewith bands of continuously curved surfaces from the flat outer surface 55 of top closure 54 of shell upper portion 56 to the outer end 59 of bottle sealing portion 52 that extends inwardly from shell lower portion 57. An example of a continuous curved surface band is identified by the number 80 in FIG. 10. Consequently, as with the preferred embodiment of the invention described heretofore, the modified bottle cap has a shell the major portion of which has a semi-spherical surface. Obviously the proportion of sphericity is a function of the size and number of faces in the intermediate portion 58. The flat faces 61–66 are generally parallel to central axis a—a of bottle cap 50 and perpendicular to a plane through transverse axis b—b. In all other respects the modified novelty bottle cap-toy top of FIGS. 9–12 is similar to the bottle cap-toy top described above in FIGS. 1–4.

After modified bottle cap-toy top 50 is removed from a bottle and placed on a horizontal surface, the cap will normally roll on the surface of the shell upper portion 56 and one or more of the curved transition sections of shell intermediate portion 58 until the shell 51 comes to rest on one of the faces 61–66 of the intermediate portion 58. When the stem 53 is grasped between a person's thumb and fingers, with flat outer surface 55 of top closure 54 down, and caused to rapidly spin on a horizontal surface 90, the cap-toy top will rotate out of its central longitudinal axis and through even larger circles, as illustrated previously for cap-toy top 20 in FIGS. 5–7. Cap-toy top 50 will first turn on flat outer surface 55 and then roll on the surface of its upper portion 56, then on one of the transition sections 71–77, and thereafter on the surface of bottom portion 57 until the end of stem portion 53 contacts horizontal surface 90. The contact of stem portion 53 with surface 90 will cause cap-toy top 50 to rotate or jump into an inverted position on the end of stem portion 53 and continue spinning. When spinning cap-toy top 50 loses speed, it will fall over onto shell 51 and come to rest, with one flat surface in contact with surface 90. For example, as shown in FIG. 13, cap-toy top 50 has come to rest with face 64 down in contact with surface 90 and face 61 facing upwardly.

By manufacturing bottle cap-toy top 50 with shell intermediate portion 58 having six faces 61–66, each marked with a different number of dots 1–6; and using such to, one can play a game of dice. In similar fashion one can play a game of poker with a bottle cap-toy top having five faces on the intermediate portion of the shell.

Modifications and alterations may be made by others upon their review of this specification and it is my intention to include such modifications and alterations insofar as they come within the scope of the appended claims.

I claim:

1. A novelty bottle cap-toy top adapted to close the open end of a bottle and to be used as a toy top, comprising:

A. a hollow semi-spherical shell comprising:
  1. an upper portion having
    (a) a flat top surface segment, and
    (b) a semi-hemispherical surface;
  2. a lower portion having
    (a) a semi-hemispherical surface, and
    (b) an inwardly extending bottle sealing portion designed and constructed to engage and seal the open end of said bottle; and B. a stem portion extending outwardly from the interior of said hollow shell through said bottle sealing portion of the lower portion of said hollow shell.

2. A novelty bottle cap-toy top adapted to close the open end of a bottle and to be used as a toy top, comprising:

A. a hollow semi-spherical shell, having a central axis, comprising:
  1. an upper portion having
    (a) a flat top surface segment substantially perpendicular to the central axis of said shell, and
    (b) a semi-hemispherical surface;
  2. a lower portion having
    (a) a semi-spherical surface, and
    (b) an inwardly extending bottle sealing portion substantially co-axial with the central axis of said shell and designed and constructed to engage and seal the open end of said bottle; and B. a stem portion substantially co-axial with the central axis of said shell and extending outwardly from the interior of said hollow shell through said bottle sealing portion of the lower portion of said hollow shell.

3. The novelty bottle cap-toy top as defined in claim 2 wherei the diameter of the hollow semi-spherical shell is 1.5 times the outside diameter of the open end of the bottle said cap-toy top is to seal.

4. The novelty bottle cap-toy top as defined in claim 2 wherein

A. said bottle sealing portion comprises:
  1. an inner end,
  2. a bottle contact surface,
  3. a circular outer end that connects with the lower portion of said shell in a plane that extends peripendicular to the central axis of said shell; and B. said stem portion comprises:
  1. an upper section, and
  2. a lower section extending downwardly through the circular outer end of said bottle sealing portion and having a tip portion on the end thereof.

5. The novelty bottle cap-toy top as defined in claim 2 wherein said stem portion comprises:

A. an upper truncated conical section, and

B. a lower cylindrical section having longitudinally extending serrations about a portion of the surface thereof.

6. A novelty bottle cap-toy top adapted to close the open end of a bottle and to be used as a toy top, comprising:

A. a lower portion, having a central axis, comprising:
  1. a semi-hemispherical shell portion, and
  2. a circular open bottle sealing portion co-axial with said central axis and extending inwardly from said shell;

B. an upper portion, having a central axis co-axial with said central axis of said lower portion, comprising:
  1. a semi-hemispherical shell portion,
  2. a stem portion, co-axial with said upper portion central axis, extending inwardly of said upper portion shell portion, and through and beyond said lower portion circular bottle sealing portion; comprising:
    (a) an upper truncated hollow conical portion connecting at the upper end thereof with the upper portion semihemispherical shell portion and having an opening in the upper end thereof, and
    (b) a lower portion extending beyond said lower portion circular bottle sealing portion; and C. a top closure sealing the opening in the upper end of the upper truncated hollow conical portion of the stem portion and having a substantially flat top surface 7. A novelty bottle cap-toy top adapted to close the open end of a bottle and to be used as a toy top, comprising:

A. a hollow semi-spherical shell comprising:
  1. an upper portion having
    (a) a flat top segment, and
    (b) a semi-hemispherical surface;
  2. a lower portion having
    (a) a semi-hemispherical surface, and
    (b) an inwardly extending bottle sealing portion designed and constructed to engage and seal the open end of said bottle;
  3. an intermediate portion, extending between said upper portion and said lower portion, comprising:
    (a) plurality of transition sections with convexly curved surfaces, and
    (b) a plurality of substantially flat faces and;

B. a stem portion extending outwardly from the interior of said hollow shell through said bottle sealing portion and therebeyond, said stem portion comprising:
  1. a lower section having an end, whereby said stem may be grasped between a person's fingers and caused to spin on a horizontal surface, first on the flat top segment of the upper portion, then in ever widening circles on the semi-hemispherical surface of the upper portion, onto a convexly curved surface of a transition section of the intermediate portion, and onto the semi-hemispherical surface of the lower portion until the end of the lower stem contacts said horizontal surface causing the bottle cap to jump into an inverted position and spin on the end of the stem until the spinning slows, and the cap falls and comes to rest with one of the flat faces of the cap intermediate portion resting on the horizontal surface.

* * * * *